US006503372B1

(12) United States Patent
Rokman et al.

(10) Patent No.: US 6,503,372 B1
(45) Date of Patent: Jan. 7, 2003

(54) TWIN WIRE FORMER ASSEMBLY

(75) Inventors: Kay Rokman, Karhula (FI); Juhani Jansson, Karhula (FI); Eino Laine, Kyminlinna (FI)

(73) Assignee: Ahlstrom Glassfibre Oy (FI)

( * ) Notice: Subject to any disclaimer, the term of this patent is extended or adjusted under 35 U.S.C. 154(b) by 0 days.

(21) Appl. No.: 09/702,810

(22) Filed: Nov. 1, 2000

Related U.S. Application Data

(62) Division of application No. 09/260,024, filed on Mar. 2, 1999, now Pat. No. 6,238,518.

(51) Int. Cl.[7] ..... D21F 1/00; D21F 1/06

(52) U.S. Cl. ..... 162/336; 162/300; 162/301; 162/339; 162/337; 162/101; 162/100

(58) Field of Search ..... 162/101, 100, 162/336, 300, 301, 339, 337

(56) References Cited

U.S. PATENT DOCUMENTS

| | | | |
|---|---|---|---|
| 3,716,449 | A | 2/1973 | Gatward et al. |
| 3,871,952 | A | 3/1975 | Robertson |
| 3,923,593 | A | 12/1975 | Verseput |
| 3,938,782 | A | 2/1976 | Robertson |
| 4,141,788 | A | 2/1979 | Justus |
| 4,181,568 | A | 1/1980 | Pfaler |
| 4,349,414 | A | 9/1982 | Stenberg |
| 4,376,014 | A | 3/1983 | Bergstrom |
| 4,443,297 | A | 4/1984 | Cheshire et al. |
| 4,445,974 | A | 5/1984 | Stenberg |
| 4,986,882 | A | 1/1991 | Mackey et al. |
| 5,129,988 | A | 7/1992 | Farrington, Jr. |
| 5,183,537 | A | 2/1993 | Hergert et al. |
| 5,490,905 | A | 2/1996 | Huovila et al. |
| 5,560,807 | A | 10/1996 | Hauser |
| 5,639,349 | A | 6/1997 | Begemann et al. |
| 5,651,862 | A | 7/1997 | Anderson et al. |
| 5,720,851 | A | 2/1998 | Reiner |
| 5,766,419 | A | 6/1998 | Linsuri et al. |
| 6,019,871 | A | 2/2000 | Rokman et al. |

*Primary Examiner*—Steven P. Griffin
*Assistant Examiner*—Mark Halpern
(74) *Attorney, Agent, or Firm*—Nixon & Vanderhye P.C.

(57) ABSTRACT

A non-woven web of cellulosic synthetic fibrous material is produced using a twin wire former. The former may have a closed first end and closed first and second sides, and a second end provided by first and second moving foraminous elements. An interior structure between the sides and second end may have at least first and second different length pluralities of conduits extending from the former first end toward the second end, and defining by themselves, or with wall elements, the interior volume into a first volume and a second volume on opposite sides thereof. A first fiber/foam slurry is introduced into the first volume and a second fiber/foam slurry in the second volume, and suction box assemblies are provided on the opposite sides of the foraminous elements from the interior volume for withdrawing foam from the slurries to forming a non-woven web on the foraminous elements. At least a third material is introduced using the interior structure so that the third material does not come into direct contact with either foraminous element, and the third material may form stripes in the web. The positions of the at least third material third conduits may be adjusted one or both of vertically and horizontally.

21 Claims, 6 Drawing Sheets

TWIN WIRE FORMER ASSEMBLY

BACKGROUND AND SUMMARY OF THE INVENTION

This application is a division of U.S. Ser. No. 09/260,024, filed Mar. 2, 1999, now U.S. Pat. No. 6,238,518, issued May 29, 2001.

A foam laid process for making non-woven webs is an alternative to the liquid laid process (such as shown in U.S. Pat. No. 4,349,414) that has a number of advantages over the liquid process. One of the most important advantages of the foam laid process is that the specific gravity of fibers or additives may be anywhere within the range of 15–13. The basic manner in which the foam laid process is practiced, and the advantages associated therewith, are described in U.S. Pat. Nos. 3,716,449, 3,871,952, and 3,938,782 (the disclosures of which are incorporated by reference herein).

According to the present invention the foam laid process is used to produce non-woven webs that can have one, two, three, or more strata, in an effective manner. The method and apparatus according to the invention may be used with almost any cellulose and/or synthetic fibers.

More generally, according to the invention a composite may be formed of one, two or three layers, or any combination thereof. As an example of a three-layered product may be produced as a composite comprising: a top layer formed of synthetic fibers (for example polyester, polyamide, polypropylene, etc.), cellulose and/or binder fibers; a middle layer formed of synthetic fibers, cellulose fibers and/or ion exchange resins, particles, fillers, super absorbents, different kinds of fillers, including possibly in particle form; and a bottom layer formed of a mixture of synthetic and cellulose fibers. The layers may be distinct (i.e. the mixing or interaction between the adjacent layers is very weak), or they may be mixed (bound) together very efficiently.

More generally, according to the invention a composite may be formed of one, two or three layers, or any combination thereof. As an example of a three-layered product may be produced as a composite comprising: a top layer formed of synthetic fibers (for example polyester, polyamide, polypropylene, etc.), cellulose and/or binder fibers; a middle layer formed of synthetic fibers, cellulose fibers and/or ion exchange resins, sticky materials, different kinds of fillers, including possibly in particle form; and a bottom layer formed of a mixture of synthetic and cellulose fibers. The layers may be distinct (i.e. the mixing or interaction between the adjacent layers is very weak), or they may be mixed (bound) together very efficiently.

The method and apparatus specifically according to the invention are utilized in a larger foam-laid process and system in which a variety of the techniques are optimized. However according to one specific aspect of the present invention, a method of producing a non-woven web of cellulosic and synthetic fibrous material is provided which comprises the following steps: (a) Forming a first foam slurry of air, water, cellulose or synthetic fibers, and surfactant. (b) Forming a second foam slurry of air, water, cellulose or synthetic fibers, and surfactant. (c) Moving a first foraminous element in a (e.g. generally vertical, though orientation is usually not critical) first path. (d) Moving a second foraminous element in a (e.g. generally vertical) second path. (e) Passing the first foam slurry directly into contact with the first foraminous material moving in the first path. (f Passing the second foam slurry directly into contact with the second foraminous material moving in the second path. (g) Passing a third material, different from the first and second foam slurries, (e.g. generally upwardly) in between the first and second foam slurries so that the third material does not directly contact either of the first and second foraminous elements. And, (h) forming a fibrous web from the first and second foam slurries and third material by withdrawing foam and liquid from the slurries through the first and second foraminous elements.

Step (g) may be practiced by introducing a third material, such as sticky particles, or fillers, at a consistency of between about 5–20% that would tend to stick to the first and second foraminous elements (such as conventional forming wire belts) if allowed to contact them. Steps (a) and (b) may be practiced by introducing first and second foam slurries that are different than each other.

Steps (e) and (f) are typically practiced in a headbox and there is a further step of introducing substantially pure foam into one or both of the first and second foam slurries just before the headbox. The introduction of the substantially pure foam into the fiber foam slurry improves the flowability of the foam and has other advantages. The third material is introduced directly into contact with the first and second foam slurries, there being no necessity to provide an air gap or the like between them. The final non-woven web leaving the former produced may have a consistency of about 20–60%, with a basis weight variation of less than about one-half percent.

According to another aspect of the present invention a former, which may be a twin wire former, an inclined wire former, a rotoformer, or a fourdrinier former, assembly is provided comprising the following components: A former having a closed first end (e.g. bottom), closed first and second sides, and an interior volume. A second end (e.g. top) of the former provided by a moving at least one (e.g. first and second) foraminous element. An interior structure (e.g. substantially vertical) between (and possibly generally parallel) to the first and second sides, and having a plurality of conduits therein extending from the former first end toward the second end. The interior structure defining the interior volume into a first volume on one side thereof and a second volume on the other side thereof. Means for introducing a first fiber/foam slurry into the first volume, and a second fiber/foam slurry into the second volume. Means for withdrawing foam from the first and second slurries through the one, or first and second, foraminous elements to form a non woven web on the foraminous element or elements. And, means for introducing a third material into the conduits within the interior structure.

The means for withdrawing foam from the first and second slurries through the foraminous element(s) may comprise any conventional means for that purpose, such as suction rollers, pressing rollers, or other conventional structures. In the preferred embodiment illustrated in the drawings first and second suction box assemblies are provided mounted on the opposite sides of the interior structure from first and second foraminous elements.

The means for introducing first and second foam slurries into the first and second volumes may comprise any conventional type of conduit, nozzle, orifice, header, or the like. Typically a plurality of conduits are provided disposed on the first end (e.g. bottom) of the former and facing the second end (e.g. upwardly), and/or conduits, nozzles, orifices or the like are provided for introducing the foam slurry into the first and second side walls of the headbox. Foaming nozzles are typically connected to at least one of the conduits connected to the first end (e.g. bottom) of the former, the side walls of the former, and disposed within the conduits themselves.

While the former is described as generally vertical, with the second end the top, it may have a wide variety of other orientations, including a wide variety of inclines (e.g. about 45° and the third material moving generally upwardly at about 45°), or the second end forming the bottom. The plurality of conduits may have a first small cross-sectional area adjacent the headbox bottom and a second cross-sectional area, at least twice as great as the first cross-sectional area, adjacent the top. For example the conduits may open into the interior volume at the top of the interior structure, and flare outwardly so that at the top the conduits extends almost completely across the top of the interior structure.

Typically the interior structure is positioned with respect to the foraminous elements so that material introduced through the interior structure will not directly contact the first and second foraminous elements. This is particularly useful for introducing sticky third materials, but may also be useful when forming stratified structures, including a foam fiber slurry as the third material. The first and second fiber foam slurries may be the same, or different, from each other and from the third material (if a foam slurry).

The method and apparatus specifically according to the invention are utilized in a larger foam-laid process and system in which a variety of the techniques are optimized. However according to one specific aspect of the present invention, a method of producing a non-woven web of cellulosic and synthetic fibrous material is provided which comprises the following steps: (a) Forming a first foam slurry of air, water, cellulose or synthetic fibers, and surfactant. (b) Forming a second foam slurry of air, water, cellulose or synthetic fibers, and surfactant. (c) Moving a first foraminous element in a first path. (d) Moving a second foraminous element in a second path, a nip area provided at a location along the first and second paths. (e) Passing the first foam slurry directly into contact with the first foraminous material moving in the first path. (f) Passing the second foam slurry directly into contact with the second foraminous material moving in the second path. (g) Passing at least a third material, different from the first and second foam slurries, in between the first and second foam slurries so that the third material does not directly contact either of the first and second foraminous elements, and by introducing the third material at a plurality of different points, e.g. spaced different distances from the nip area, and/or make stripes within the product using the third material. And, (h) forming a fibrous web from the first and second foam slurries and third material by withdrawing foam and liquid from the slurries through the first and second foraminous elements.

Step (g) may be practiced by introducing a third material that would tend to stick to the first and second foraminous elements (such as conventional forming wire belts) if allowed to contact them. Steps (a) and (b) may be practiced by introducing first and second foam slurries that are different than each other.

Steps (e) and (f) are typically practiced in a headbox and there is a further step of introducing substantially pure foam into one or both of the first and second foam slurries just before the headbox. The introduction of the substantially pure foam into the fiber foam slurry improves the flowability of the foam and has other advantages. The third material is introduced directly into contact with the first and second foam slurries, there being no necessity to provide an air gap or the like between them. The final non-woven web leaving the former may have a consistency of about 20–60%, with a basis weight variation of less than about one-half percent.

The method may be implemented wherein step (g) is further practiced by automatically adjusting the positions of at least some of the plurality of points when desired to adjust the introduction points in a first dimension toward and away from the nip area; and/or wherein step (g) is further practiced to automatically adjust at least some of the plurality of points in a second dimension substantially transverse to the first dimension. The method may also include the situation wherein step (g) is practiced utilizing a plurality of distinct conduits, the conduits being of at least two different lengths; and steps (e), (f), and (g) may be practiced by providing dividing walls extending part of the length of the conduits toward the nip area.

Step (g) is preferably further practiced by passing the third material in between the first and second foam slurries after the first and second foam slurries have contacted the first and second foraminous elements, respectively, and foam and liquid are being withdrawn therefrom, or at least at such a late stage where the third material does not have sufficient time to mix with the other materials/layers before web formation of the other materials/layers starts. Step (g) may also be practiced by passing third and fourth materials, different from each other and both different from the first and second foam slurries, in between the first and second foam slurries, the third and fourth materials being introduced at spaced different distances from the nip area, and/or in a perpendicular dimension.

According to another aspect of the present invention a wire former assembly (twin wire, inclined wire, etc.) may be provided comprising the following components: A former having a closed first end, closed first and second sides, and an interior volume. A second end of the former provided by a moving at least one (e.g. first and second) foraminous element. An interior structure between the first and second sides, the interior structure defining the interior volume into a first volume on one side thereof and a second volume on the other side thereof. Means for introducing a first fiber/foam slurry into the first volume, and a second fiber/foam slurry into the second volume. Means for withdrawing foam from the first and second slurries through the foraminous element(s) to form a non-woven web on the foraminous element(s). And, means for introducing at least a third material through the interior structure, in such a way that the third material forms stripes in the web produced.

The means for introducing the at least third material may comprise any conventional fluidic structures such as nozzles, baffles, manifolds, pumps, or the like. Preferably the introducing means comprise at least a first plurality of pipes having a first effective length, though also a second plurality of pipes having a second effective length different than the first length may be used. Also more than two sets of pipes may be used.

There also may be powered means for moving the introducing means to different positions within the interior structure to adjust the location within the interior structure that the third material is introduced. The powered moving means may comprise any conventional structures such as pneumatic or hydraulic cylinders, rack and pinion gearing, screw threaded shafts with traveling nuts, etc. The powered moving means may comprise a first moving means operatively connected to the first plurality of pipes, and a second moving means, distinct from the first moving means and operating independently therefrom, operatively connected to the second plurality of pipes. The powered means may also comprise means for moving the introducing means toward and away from the second end of the former, and may still further comprise means for moving the introducing means in a dimension substantially transverse to toward and away from the second end of the former.

Preferably the interior structure is positioned at substantially all times during the normal range of movement thereof to discharge the at least third material at a location, e.g. preferably past where the means for withdrawing foam from the first and second slurries starts withdrawing foam from the slurries, or at least at such a late stage where the third material does not have sufficient time to mix with the other materials/layers before web formation of the other materials/layers starts. The interior structure may also further comprise first and second substantially solid wall elements straddling the first and second plurality of pipes and disposed between the first and second plurality of pipes and the foraminous element(s), the wall elements having a terminal portion closest to the second end of the former at a location past where the means for withdrawing foam from the first and second slurry starts withdrawing foam from the slurries. The first and second wall elements typically do not extend as far as the first and second plurality of pipes toward the second end of the former.

The former first end may be above the former second end, and a void space may exist above the terminal portions of the wall elements in-between the wall elements; however the former may have any orientation with respect to the vertical. This void area may be slightly pressurized if desired. Alternatively, the at least third material introducing means may further comprise introduction openings at the first end of the former spaced from the terminal discharges of the first and second plurality of pipes for introducing the same material as introduced by the pipes, or a different material.

The means for withdrawing foam from the first and second slurries through the foraminous element(s) may comprise any conventional means for that purpose, such as suction rollers, pressing rollers, or other conventional structures. In the preferred embodiment illustrated in the drawings first and second suction box assemblies are provided mounted on the opposite sides of the interior structure from the foraminous element(s).

While the former is illustrated as generally vertical, with the second end the bottom, it may have a wide variety of other orientations, including a wide variety of inclines (e.g. about 45° and the third material moving generally upwardly at about 45°), or the second end forming the top. The plurality of conduits may have a first small cross-sectional area adjacent the headbox bottom and a second cross-sectional area, at least twice as great as the first cross-sectional area, adjacent the top. For example the conduits may open into the interior volume at the bottom of the interior structure, and flare outwardly so that at the bottom the conduits extends almost completely across the top of the interior structure.

It is the primary object of the present invention to provide a method and apparatus for effectively producing a non-woven web of cellulose or synthetic fibrous material utilizing foam-laid techniques, and distinctly introduced materials. This and other objects of the invention will become clear from an inspection of the detailed description of the invention and from the appended claims.

DETAILED DESCRIPTION OF THE DRAWINGS

Figure 1:
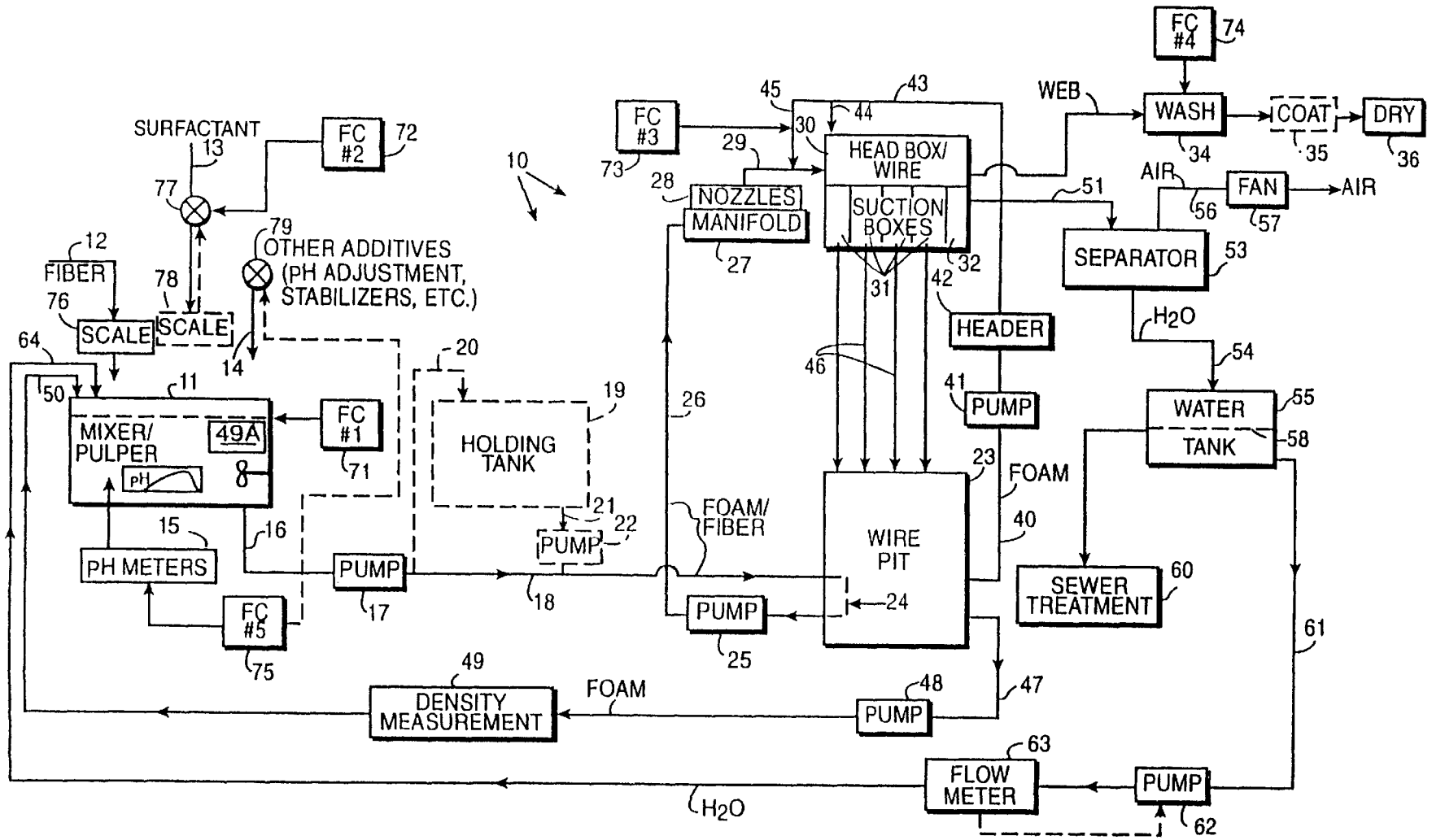
FIG. 1 is a general schematic illustration of a foam laid process system in which the method of the invention may be practiced and the apparatus of the invention utilized.

The general foam-based system in which the method and system according to the present invention are used for making cellulose and synthetic fiber non-woven mats or webs according to the present invention, is illustrated schematically at 10 in FIG. 1. The system includes a mixing tank or pulper 11 having a fiber input 12, a surfactant input 13, and an input 14 for other additives, such as pH adjustment chemicals like calcium carbonate or acids, stabilizers, etc. The particular nature of the fibers, surfactant, and additives is not critical and they may be varied widely depending upon the exact details of the product being produced (including its basis weight). It is desirable to use a surfactant that can be fairly readily washed out since a surfactant reduces the surface tension of the final web if it is still present, and that is normally an undesirable feature for some products. The exact surfactant used, out of the thousands that are commercially available, is not part of the present invention.

The tank 11 is per se entirely conventional, being the same type of tank that is used as a pulper in conventional paper making systems using the water-laid process. The only differences are that the side walls of the mixer/pulper 11 are extended upwardly about three times the height in the water-laid process since the foam has a density about a third that of water. The rpm and blade configuration of the conventional mechanical mixer in the tank 11 is varied depending upon the particular properties of the product being produced, but is not particularly critical, and a wide variety of different components and variables may be employed. Brakers may also be provided on the walls. There is a vortex at the bottom of the tank 11 from which the foam drains, but the vortex is not visible once start up occurs because the tank 11 is filled with foam and fiber.

The tank 11 also preferably includes therein a large number of pH meters 15 for measuring the pH at a number of different points. pH affects surface tension, and thus desirably is accurately determined. The pH meters are calibrated daily.

At initial start up, water is added with the fiber from line 12, the surfactant from line 13, and other additives in line 14; however, once operation commences no additional water is necessary and there is merely foam maintenance in the tank 11, not merely foam generation.

The foam exits the bottom of the tank 11, in a vortex, into line 16 under the influence of the pump 17. The pump 17, like all other pumps in the system 10, preferably is a degassing centrifugal pump. The foam discharged from the pump 7 passes in line 18 to further components.

FIG. 1 illustrates an optional holding tank 19 in dotted line. The holding tank 19 is not necessary but may be desirable to ensure a relatively even distribution of the fiber in the foam in case there is some variation that is introduced into the mixer 11. That is, the holding tank 19 (which is small, typically only on the order of five cubic meters) acts more or less like a "surge tank" for evening out fiber distribution. Because the total time from mixer 11 to the headbox (30) is typically only about 45 seconds in the practice of the process, the holding tank 19—if used—provides time for variations to even out.

When the holding tank 19 is used foam is fed from the pump 17 in line 20 to the top of the tank 19, and exits the bottom of the tank in line 21 under the influence of centrifugal pump 22, then leading to line 18. That is, when the holding tank 19 is used the pump 17 is not directly connected to the line 18, but only through the tank 19.

The line 18 extends to the wire pit 23. The wire pit 23 is per se a conventional tank, again the same as in the conventional water-laid paper process system, but with higher side walls. It is important to make the wire pit 23 so that there are no dead corners and therefore the tank 23 should not be too large. The conventional structure 24 which allows the foam and fiber mixture in line 18 to be introduced into the pump 25 (which is operatively connected adjacent the bottom of the wire pit 23) will be described further with respect to FIG. 2. In any event, the pump 25 pumps the foam/fiber mixture in line 18, introduced by mechanism 24, and additional foam from the wire pit 23, into the line 26. Because a fairly large amount of foam is drawn into the pump 25 from the wire pit 23, typically the consistency in line 26 is significantly less than that in line 18. The consistency in line 18 is typically between 2–5% solids (fibers), while that in line 26 is typically between about 0.5–2.5%, although in both cases the consistency may be as high as 12%.

In the wire pit 23 there is no significant separation of the foam into layers of different density. While there is a minimal increase toward the bottom, that degree of increase is small and does not affect operation of the system.

From the line 26 the foam/fiber passes to the manifold 27 which has foam generating nozzles 28 associated therewith. Preferably the nozzles 28—which are conventional foam generating nozzles (which agitate the foam greatly) as used in the '449, '952 and '782 patents incorporated by reference herein—are mounted on the manifold 27, and a large number of the nozzles 28 are mounted on the manifold 27. Extending from each nozzle 28 is a conduit 29 which leads to the headbox 30, through which a conventional paper making wire or wires (foraminous elements) pass.

The headbox 30 has a plurality of suction boxes (typically about three to five) 31 which withdraw foam from the opposite side of the wire (foraminous element) from the introduction of the foam/fiber mixture, and a final separation box 32 is at the discharge end of the formed web 33 from the headbox 30. The number of suction boxes 31 provided in the suction table to control drainage are increased for denser products, or for higher speed operation. The formed web 33, which may have a solids consistency of about 40–60% (e.g. about 50%), is preferably subjected to a washing action as indicated schematically by wash stage 34 in FIG. 1. The wash stage 34 is to remove the surfactant. The high consistency of the web 33 means that a minimum amount of drying equipment need be utilized.

The web 33 passes from the washer 34 past one or more optional coaters 35, to the conventional drying station 36. In the conventional drying station 36 when synthetic sheath/core fibers (such as Cellbond) are part of the web 33, the dryer 34 is operated to raise the web above the melting point of the sheath material (typically polypropylene) while the core material (typically PET) does not melt. For example where a Cellbond fiber is used in the web 33, the temperature in the dryer is typically about 130° C. or slightly more, which is at or slightly above the melting temperature of the sheath fiber, but well below the approximately 250° C. melting temperature of the core fiber. In that way a binding action is provided by the sheath material, but the integrity of the product (provided by the core fiber) is not compromised.

While it is not always necessary, the process contemplates the addition of pure foam to or immediately adjacent the headbox 30 for a number of advantageous purposes. As seen in FIG. 1, the centrifugal pump 41 draws foam from the wire pit 23 into line 40. The foam in line 40 is pumped to a header 42 which then distributes the foam to a large number of different conduits 43, toward the headbox 30. The foam containing fibers, may be introduced—as indicated by line 44—directly underneath the roof of the headbox 30 (where it is an incline wire headbox), and/or via conduits 45 to the lines 29 (or nozzles 28) for introducing foam/fiber mixture into the headbox 30. The details of the foam introduction will be described with respect to FIGS. 3 through 6.

The suction boxes 31 discharge the foam withdrawn from the headbox 30 in lines 46 into the wire pit 23. Typically no pumps are necessary, or used, for that purpose.

A significant amount of the foam in the wire pit 23 is recirculated to the pulper 11. The foam is withdrawn in line 47 by centrifugal pump 48, and then passes in conduit 47 through the conventional in-line density measurement device 49 for introduction—as indicated schematically at 50—back into the tank 11. In addition to providing density measurement for the foam in line 47 at 49, as schematically illustrated in FIG. 1 one or more density measuring units (such as denseometers) 49A may be mounted directly in the tank 11.

In addition to foam recycle, there is also typically water recycle. The foam withdrawn from the last suction box 32 passes via line 51 to a conventional separator 53, such as a cyclone separator. The separator 53—e.g. by vortex action—separates air and water from the foam introduced into the separator 53 to produce water with very little air in it. The separated water passes in line 54 from the bottom of the separator 53 to the water tank 55. The air separated by the separator 53 passes in line 56, with the assistance of the fan 57, from the top of the separator 53 and is discharged to atmosphere, or used in a combustion process or otherwise treated.

A liquid level 58 is established in the water tank 55, with some liquid overflowing to sewer or treatment, as indicated schematically at 60 in FIG. 1. Water is also taken from below the level 58 in the tank 55 via line 61, and under the influence of centrifugal pump 62 is pumped in line 61 through a conventional flow meter 63 (which controls the pump 62). Ultimately, the recycled water is introduced—as indicated schematically at 64 in FIG. 1—to the top of the mixer 11.

Typical flow rates are 4000 liters per minute foam/fiber in line 18, 40,000 liters per minute foam/fiber in line 26, 3500 liters per minute foam in line 47, and 500 liters per minute foam in line 51.

The system 10 also includes a number of control components. A preferred example of various alternatives for controlling the operation of the system comprises first fuzzy controller, 71, controls the level of foam in the tank 11. A second fuzzy controller 72 controls the addition of surfactant in line 13. A third fuzzy controller 73 controls web formation in the headbox 30 area. A fourth fuzzy controller 74 is used with the washer 34. A fifth fuzzy controller 75 controls the pH meters 15, and possibly controls addition of other additives in line 14 to the mixer 11. Fuzzy control is also used for surfactant and formation control. A multi-variable control system, and a Neuronet control system, also are preferably provided overlaying the other controls. The multi-variable control also is used for controlling the efflux ratio at web formation. The variables can be changed depending upon their effect on desired process regulation, and end result.

In order to facilitate control of the various components, typically a scale 76 is associated with the fiber introduction 12 in order to accurately determine the amount of fiber being added, per unit time. A valve 77 in line 13 may be provided for controlling the introduction of surfactant, as well as a scale 78. A valve 79 may also be provided in the line 14.

In the system 10 essentially no valves are provided for intentionally contacting the foam at any point during its handling, with the possible exception of level control valves provided in lines 46.

Also, during the entire practice of the process of the system of FIG. 1 the foam is kept under relatively high shear conditions. Since the higher the shear the lower the viscosity, it is desirable to maintain the foam at high shear. The foam/fiber mixture acts as a pseudo-plastic, exhibiting non-Newtonian behavior.

The use of the foam-laid process has a number of advantages compared to the water-laid process particularly for highly absorbent products. In addition to the reduced dryer capacity because of the high consistency of the web 33, the foam process allows even distribution of virtually any type of fiber or particle (without excessive "sinking" of high density particles while low density particles do "sink" somewhat—they do not sink at all in water) into the slurry (and ultimately the web) as long as the fibers or particles have a specific gravity between about 15–13. The foam process also allows the production of a wide variety of basis weight webs, a product with increased uniformity and higher bulk compared to water-laid process products, and a very high level of uniformity. A plurality of headboxes may be provided in sequence, or two strata may be made at the same time within a headbox with a double wire, and/or the simple coaters 35 may be utilized to provide additional layers with great simplicity (like coating).

Figure 2:
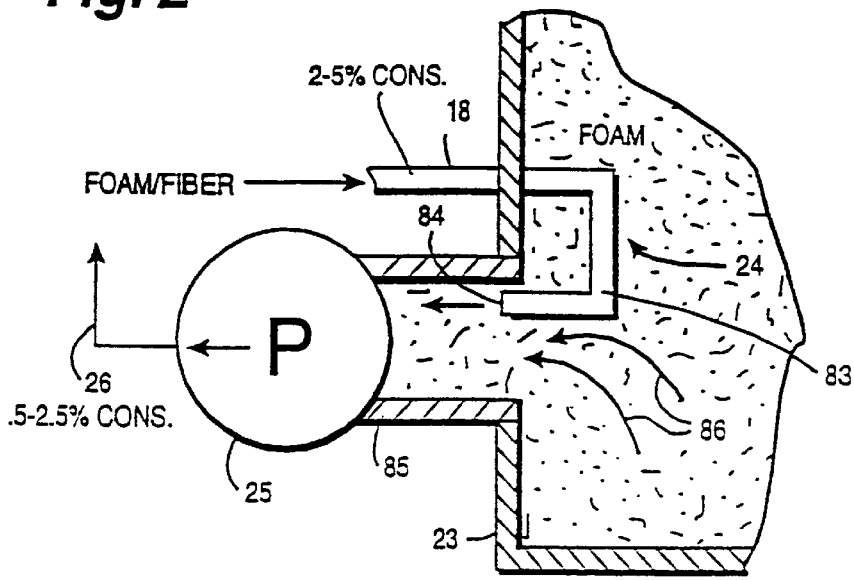
FIG. 2 is a detail schematic view, partly in cross-section and partly in elevation, showing the feed of a foam/fiber slurry from the mixer to the pump feeding the manifold and headbox of the system of FIG. 1.

FIG. 2 shows the introduction of foam/fiber mixture, and foam, to the pump 25 associated with the wire pit 23. The structure 24 is known from the Wiggins Teape process such as disclosed in the patents incorporated by reference herein, and the foam/fiber passing in line 18 is caused to be redirected as illustrated by the bent conduit 83 so that from the open end 84 thereof the foam/fiber mixture is discharged directly into the intake 85 of the pump 25. Foam from the wire pit 23 also flows into the inlet 85, as illustrated by arrows 86. Operation of pump 48, done under fuzzy control; controls the level in wire pit 23.

Where the fibers to be used to make the foam are particularly long, that is on the order of several inches, instead of directing the line 18 to the suction inlet 85 of the pump 25 (as seen in FIG. 2) the line 18 terminates in the line 26 downstream of the pump 25. In this case the pump 17 must of course provide a higher pressure than it otherwise would, that is sufficient pressure so that the flow from 18 is into the line 26 despite the pressure in line 26 from the pump 25.

Figure 3:
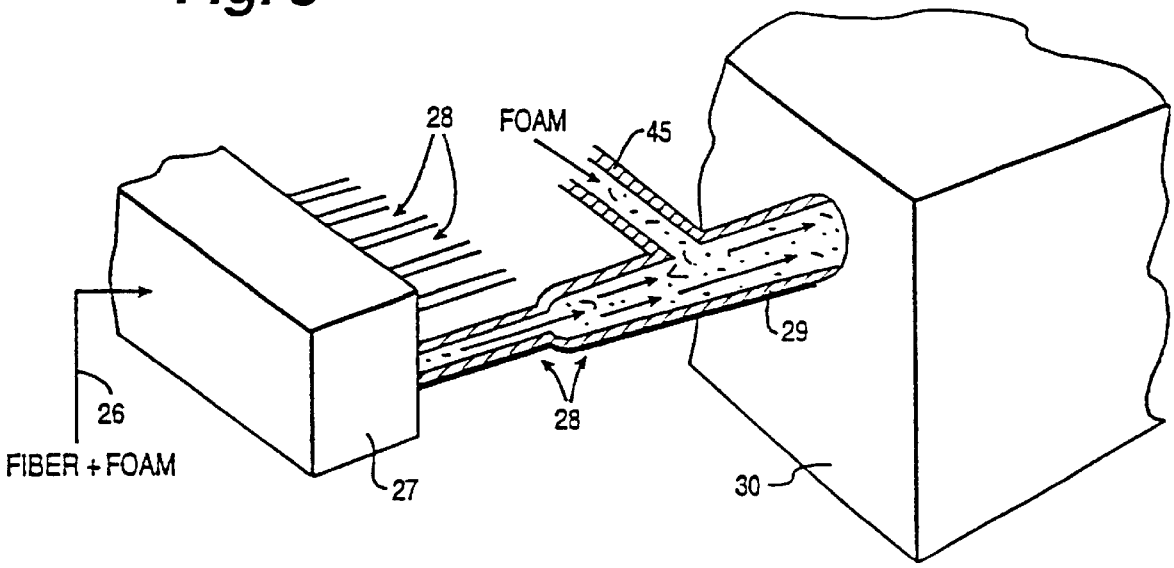
FIG. 3 is a perspective schematic detail view, partly in cross-section and partly in elevation, showing the possibility of addition of foam per se into the conduit between the manifold and the headbox.

FIG. 3 illustrates the details of one form of an additional foam introduction aspect of the process. FIG. 3 illustrates foam per se from lines 45 being introduced into the foam/fiber mixture in the conduit 29 just prior to the headbox 30. When foam injection lines 45 are utilized they need not inject foam into all of the lines 29, just enough of them to achieve the desired results. The desired results include (as a primary advantage) a more uniform basis weight profile. If desired the tubes 29 can lead the foam from the foam nozzles 28 to an explosion chamber in the headbox 30. However there is no real reason to use an explosion chamber in the headboxes for practicing the process. If used, an explosion chamber is solely for security.

Figure 4:
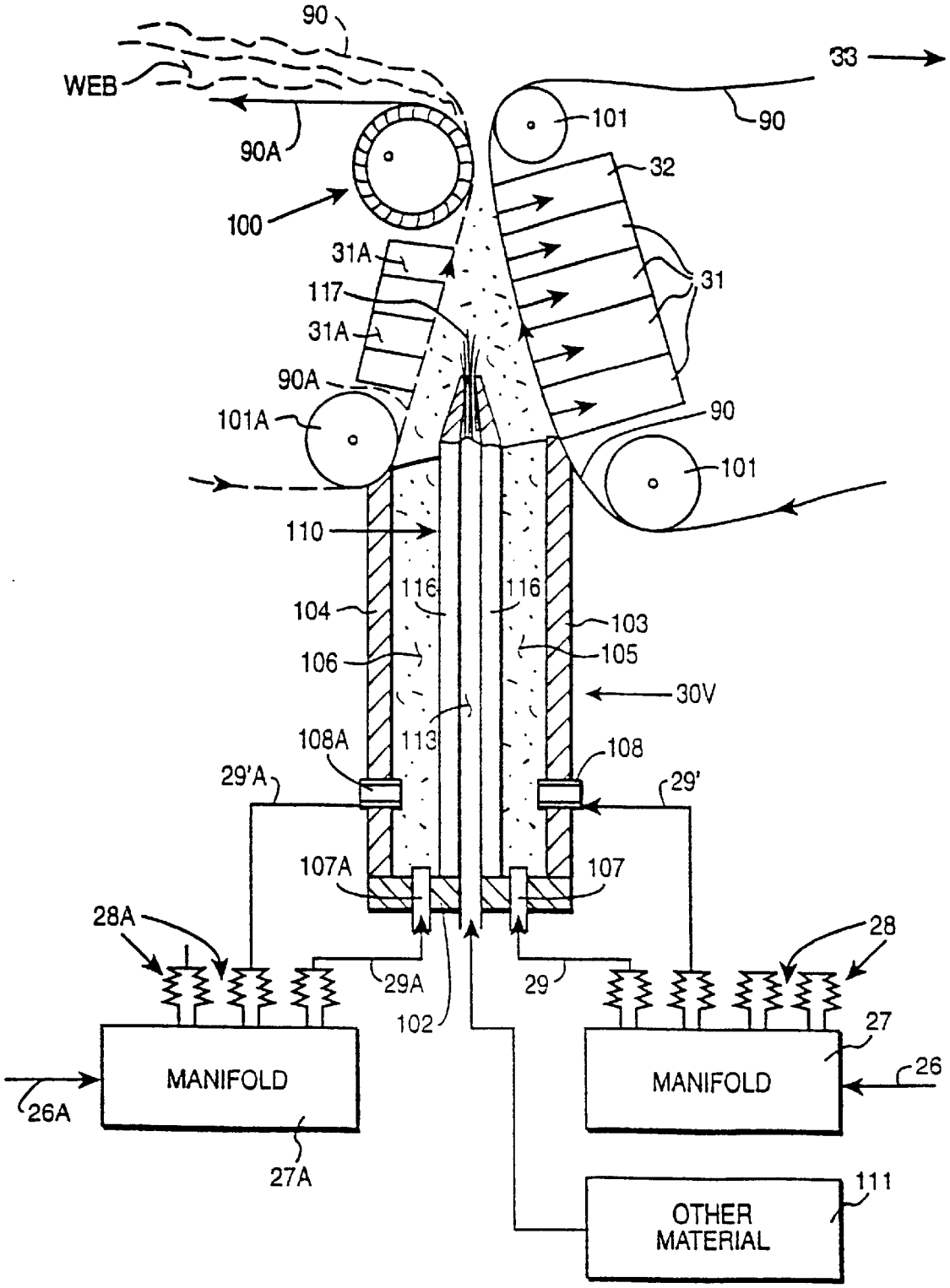
FIG. 4 is an end schematic view, partly in cross-section and partly in elevation, of an exemplary twin wire former assembly according to the present invention.
Figure 5:
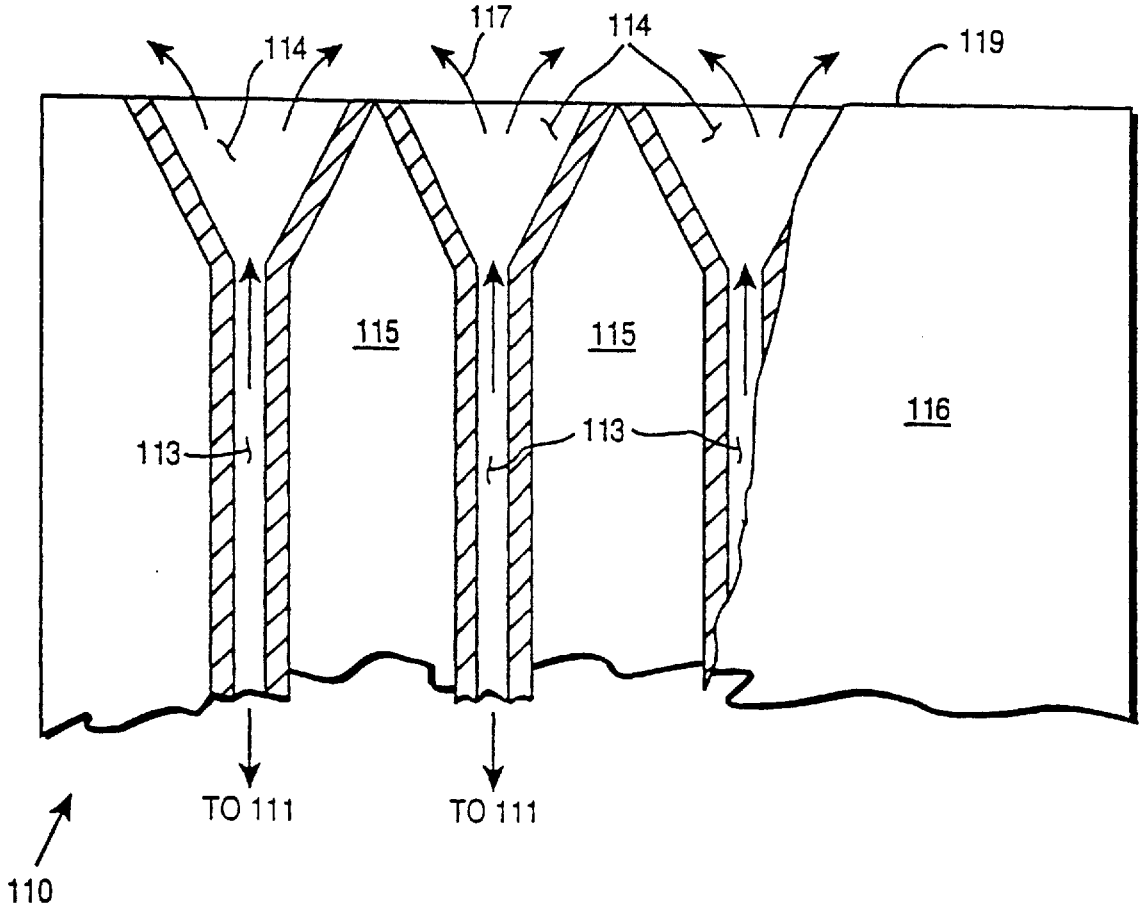
FIG. 5 is an end view, with portions of the components cut away for clarity of illustration and showing the conduits in cross-section, of the centrally located other material introducing structure of the headbox of FIG. 4.

In the practice of the method of the present invention the twin wire former (which may also be considered a headbox) configuration is illustrated in FIGS. 4 and 5 utilized, or the alternative construction of FIGS. 6–9.

In the FIGS. 4 and 5 construction, the former 30V has features in common with a conventional water-laid process dual forming wire vertical former, and includes the forming wires (foraminous elements) 90, 90A. In the embodiment described the former 30V has a vertical orientation with upward flow, but any other suitable orientation may be provided (e.g. inclined at about 45° with generally upward flow, or vertical with a downward flow). In the exemplary embodiment illustrated in FIG. 4 a suction roller 100 is shown at the discharge end of the former 30V, and rollers 101, 101A are provided for guiding the wires 90, 90A. In one embodiment the wire 90 may also be guided by the suction roller 100 as indicated in dotted line, although in normal operation the wire 90 travels over the top roller 101 along with the web 33 after discharge. Suction tables are less expensive than suction rollers, and are preferred, although suction rollers may be utilized such as indicated at 100 in FIG. 4.

It should also be understood that instead of a twin wire former other types of formers, such as inclined wire, rotoformer, or fourdrinier, formers may be utilized.

The former 30V includes a bottom (first end) 102 and side walls 103, 104. Defined between (and generally parallel to; close parallelism not being necessary) the side walls 103, 104, and a central wall structure 110 are the foam/fiber volumes 105, 106. While the same foam/fiber mixtures may be introduced into the volumes 105, 106, typically they are entirely different mixtures (e.g. containing different fibers, or some fibers different and the others the same, and possibly even different foam densities and/or surfactants) which form two distinct strata in the web 33. One foam fiber mixture is introduced from manifold 27 through nozzles 28 for example via line 29 through the bottom 102 of the former 30V as indicated by inlet 107, while the other foam/fiber mixture comes from manifold 27A, passing through nozzles 28A and being introduced into inlet 107A in the bottom 102 of the former 30V. Alternatively, or in addition, the foam/ fiber mixtures may flow in the conduits 29' and 29'A through the inlets 108 108A, respectively, in the side walls 103, 104, respectively. In any event the introduced foam/fiber mixture flows upwardly (in the illustrated embodiment, but at an angle upwardly if the former 30V is inclined, or even downwardly if the former 30V has the opposite orientation) in the chambers 105, 106 into contact with the wires 90, 90A, with suction being applied by the conventional suction boxes 31, 31A.

If desired foaming nozzles [see 128 in dotted line in FIG. 4] may be provided in one or more of the conduits 113 and enhance foaming of either a foam/fiber mixture or substantially pure foam.

The wall structure 110 in the former 30V is also illustrated in FIG. 5. The wall structure 110 is used not only to separate the first and second volumes 105, 106 of the entire interior volume of former 30V, but also to introduce additional materials into the suspension so that the materials do not come into direct contact with the wires 90, 90A. This is especially important for those materials that will stick to the wire(s), or are so fine that they pass through the wire, and thus that will foul the wires 90, 90A if they contact them. By providing introduction utilizing the wall structure 110, the introduced materials are provided just prior to actual web formation, and do not have a chance to contact the wires 90, 90A, or otherwise interfere with the processing. No air gap need be provided between the foam slurries or introduced materials.

With particular regard to FIG. 5, the interior of the structure 110 includes a plurality of conduits 113 through which additive material—such as a SAP from source 111 at a solids consistency of about 5–20%—flows (for example) upwardly until it is discharged through the enlarged triangular shaped end 114 of the conduit 113. Between the tubes 113 with their flared end terminations 114 may be provided plates 115 which hold the tubes 113 in position. The end terminations 114 may have at least twice the cross-sectional area of conduits 113, and no enlarged circular cross-section element need be provided between them. However the conduits 113 may, in some circumstances, have a uniform cross-section, or even a diverging cross-section toward the ends 114.

Plates 116 (see both FIGS. 4 and 5) are provided on the opposite sides of the tubes 113 to define a pathway for the foam/fiber mixture in the chambers 105, 106. The filler, or other material, is discharged as indicated at 117 in FIG. 5, at a point past where the filler has sufficient time to mix with the layers on wires 90, 90A before actual web formation; e.g. at a point near or past the first suction box 31, 31A, and near the center of the foam/fiber mixture at that point, so that there is almost no possibility that the material discharged at 117 will directly contact the wires 90, 90A.

The conduits 113 are preferably circular in cross-section, while the flared ends 114 have flat sides, and a substantially rectangular opening configuration where the material 117 is discharged. The flared ends 114 extend over substantially the entire top 119 of the structure 116.

The product produced utilizing the former 30V typically has two (or more) different strata which are integrally provided together in the web 33, and where the material 117 is introduced it is introduced so that it is typically between the strata, and extends partially into each strata. However the two, three or more strata may be distinct, or integrated, depending upon the particular materials and conditions.

The foam/fiber mixtures introduced in lines 29, 29', and 29A, 29'A may be the same or different. For example there may be different fibers or mixtures of fibers, have different consistencies, or otherwise have different properties. The material 111 may also be a third foam/fiber mixture which also may have different properties than one or both of the foam/fiber mixtures introduced via the manifolds 27, 27A. Pure foam may be introduced into the lines 29, 29', 29A, 29'A such as illustrated by line 45 in FIG. 3, or even into conduits 113.

In the practice of the method according to the present invention a typical example of the range of parameters that may be provided is listed in the following table. The range of parameters can be wider if the product range is wider:

| PARAMETER | VALUE |
|---|---|
| pH (substantially entire system) | About 6.5 |
| temperature | About 20–40° C. |
| manifold pressure | 1–1.8 bar |
| consistency in mixer | 2.5% |
| consistency in headbox | .5–2.5% |
| particle, filler, additive, etc. consistency | About 5–20% |
| consistency of formed web | About 40–60% |
| web basis weight variations | Less than 1/2% |
| foam density | 250–450 grams per liter at 1 bar |
| foam bubble size | .3–.5 mm average diameter (a Gaussian distribution) |
| foam air content | 25–75% (e.g. 60%, changes with pressure in the process) |
| viscosity | there is no "target" viscosity, but typically the foam has viscosity on the order of 2–5 centipoises under high shear conditions, and 200 k–300 k centipoises at low shear conditions, which ranges may be wider depending on the manner of determining viscosity. |
| web formation speed | about 200–500 meters per minute |
| specific gravity of fibers or additives | anywhere in the range of .15–13 |
| surfactant concentration | depends on many factors, such as water hardness, pH, type of fibers, etc. Normally between 0.1–0.3% of water in circulation |
| forming wire tension | between 2–10 N/cm |
| exemplary flow rate | |
| mixer to wire pit | about 4000 liters per minute |
| wire pit to headbox | about 40,000 liters per minute |
| foam recycle conduit | about 3500 liters per minute |
| suction withdrawal to water recycle | about 500 liters per minute |

In the FIGS. 6 through 9 embodiment components that are the same as those in the FIGS. 4 and 5 embodiment are shown by the same reference numeral.

In the embodiment illustrated in FIGS. 6 through 9, the twin wire former assembly 209 (or an inclined wire former, or other type of former) is illustrated so that the second end thereof is the bottom rather than the top, but it still has a substantially vertical orientation (although other orientations may also be provided). In this embodiment the interior structure 210 does not have the same type of closed walls over substantially the entire length of the third (or more) material introducing conduit (shown collectively by reference numeral 213), but rather the conduits 213 are more exposed, although the first and second wall elements 214, 215 may be provided. The conduits 213 comprise a first plurality of pipes, 216, having a first effective length from the top 217 of the former toward the second end 218 thereof (which also comprises a nip), and a second plurality of pipes 219 having a second effective length different than the first length. Pipes having other, different, effective lengths may also be provided. The same (third) material may be introduced through all of the pipes 216, 219, or different materials in the pipes 216 than in the pipes 219. Preferably the terminal ends, through which the third or fourth material flows, of the pipes 216, 219 are positioned in the former 210 past where the suction boxes 31, 31A start withdrawing foam from the slurry, that is where the non-woven web formation starts. Any suitable structure (such as suction, another wire, etc.) may be provided to maintain the web in contact with the wire 90A past the former second end/nip 218. Also any suitable termination may be provided for pipes 216, 219 (e.g. round, elliptical, flared outwardly in one or two dimensions, conical, etc.), or material may flow therethrough through radial openings near the end termination.

The pipes 216 and/or 219 can be particularly suitable for introducing stripes of third material between the first and second materials.

If desired, the pipes 216, 219 can be moved in a first dimension 220 toward and away from the former second end 218, and also in a second dimension 221 substantially perpendicular to the dimension 220 (e.g. horizontal). This movement may be accomplished manually or by any suitable powered means of any conventional type including, but not limited to, piston and cylinder assemblies (hydraulic or pneumatic), linear mechanical actuators such as rotating screw shafts with traveling nuts, stepper motors, rack and pinion systems, etc.

Figure 7:
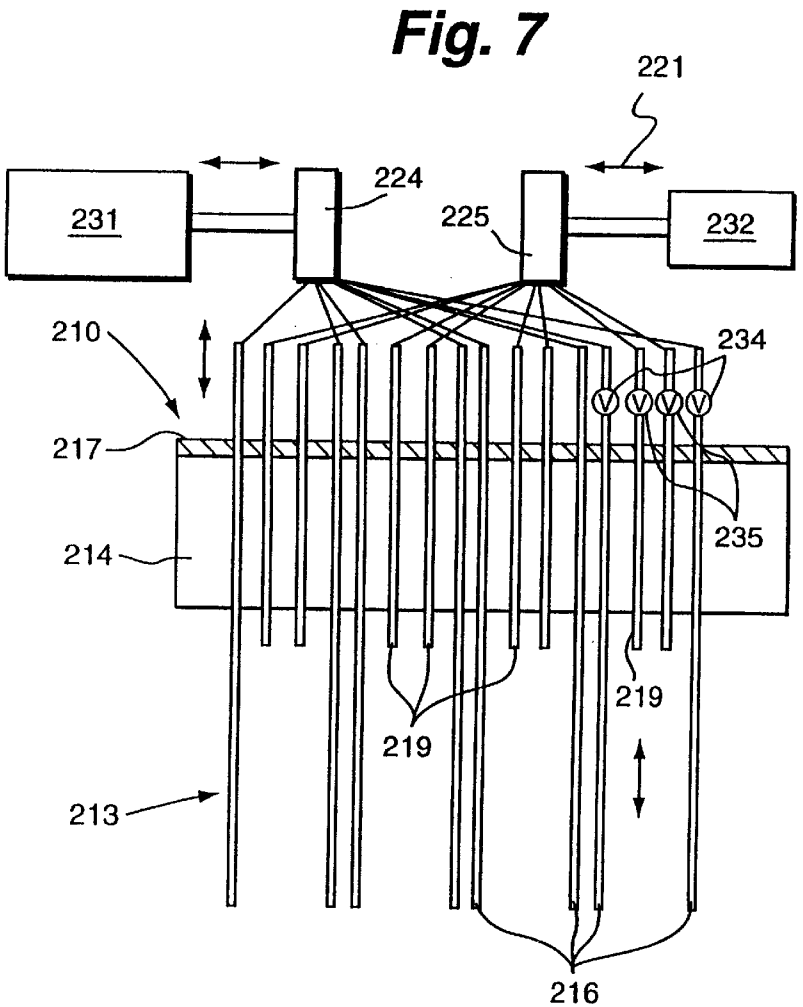
FIG. 7 is a side schematic view of the embodiment of FIG. 6 with all extraneous components cut away for clarity of illustration, and showing additional movement options of the apparatus.
Figure 6:
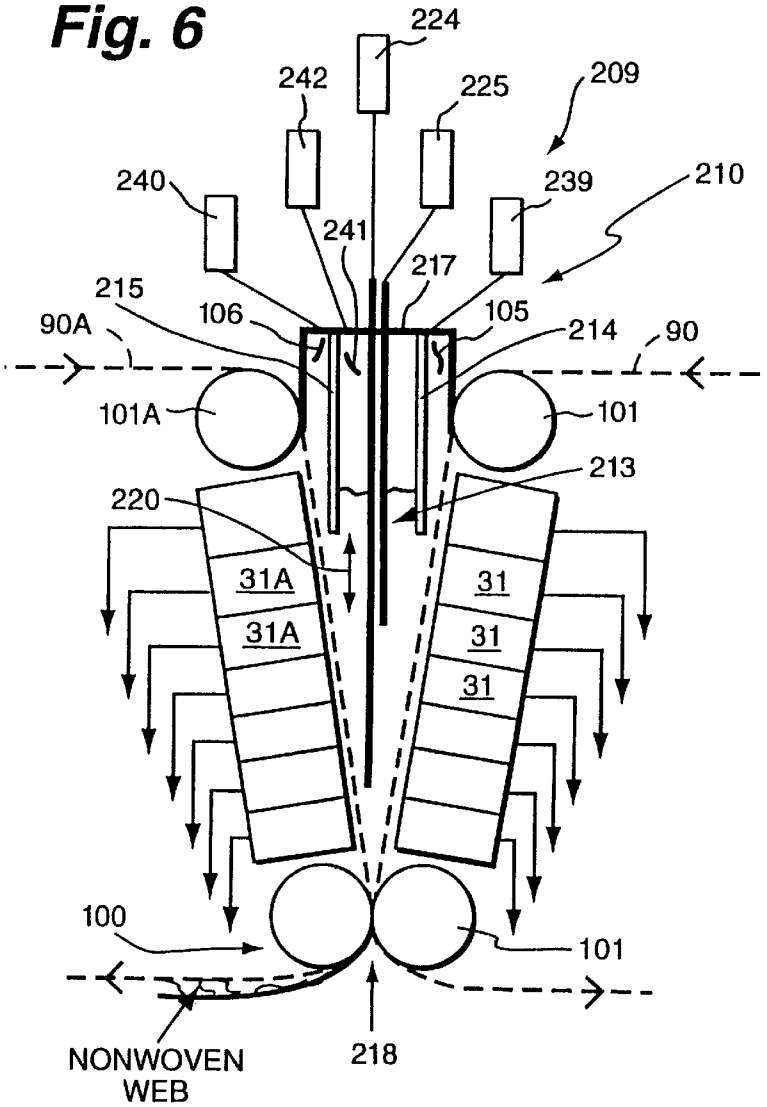
FIG. 6 is a side schematic view of another embodiment of a foam laid process system in which the method of the invention may be practiced and in which another embodiment of the interior structure of the apparatus of the invention is utilized.
Figure 8:
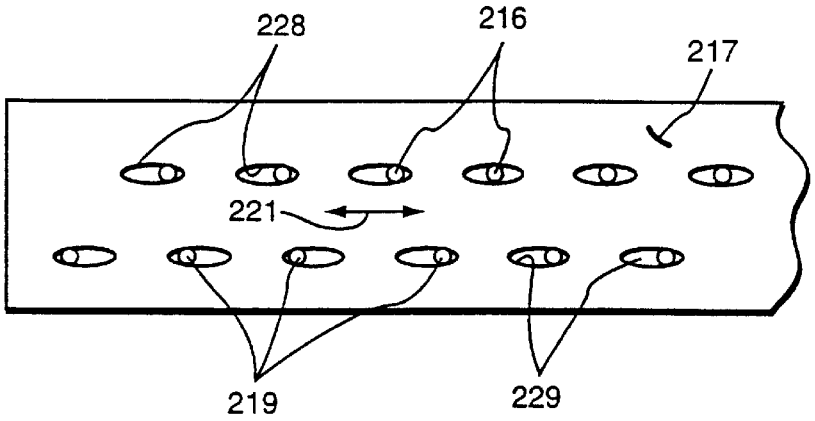
FIG. 8 is a schematic top plan view of part of the wall of the apparatus of FIGS. 6 and 7 just penetrated by the pipes, with the pipes shown schematically as circles.
Figure 9:
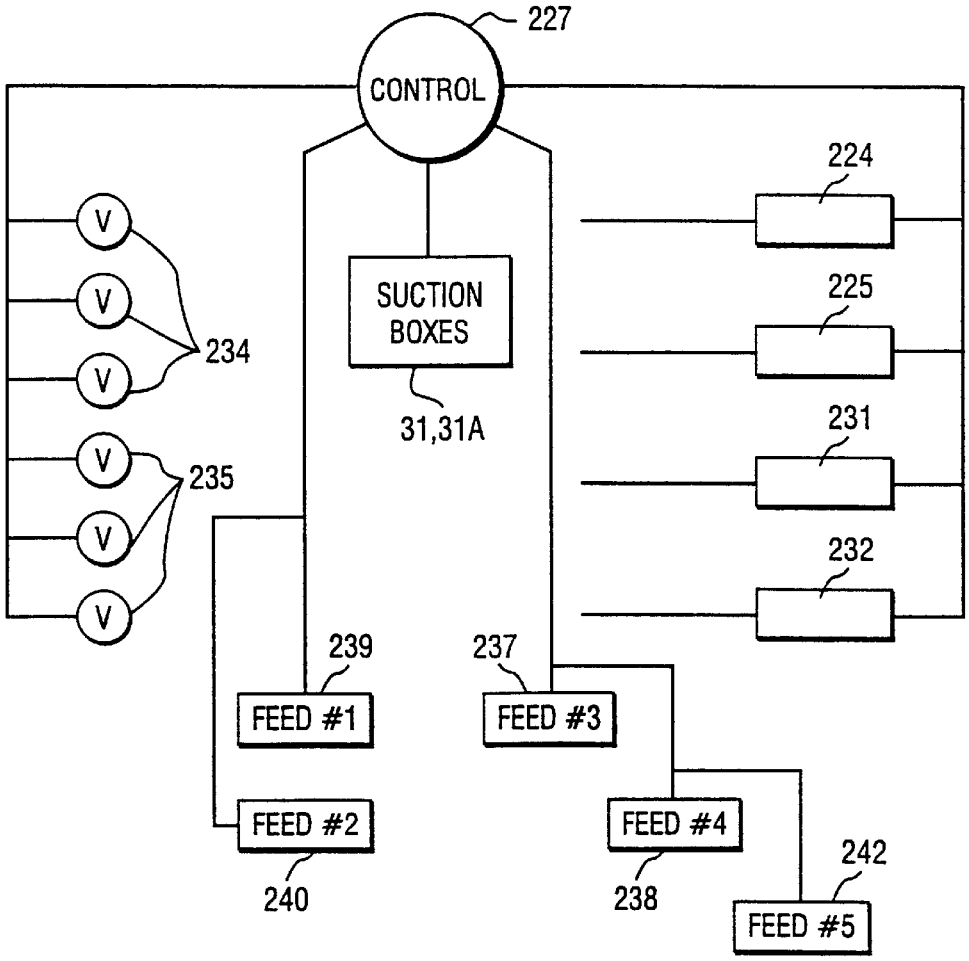
FIG. 9 is a schematic control diagram illustrating control of various components of the apparatus of FIGS. 6 through 8.

Exemplary powered means for effecting the movement in dimension 220 are illustrated schematically by piston and cylinder assemblies 224, 225 respectively in FIGS. 6, 7, and 9. The first powered means 224 is connected to the first plurality of pipes 216 by any suitable mechanical connection, such as a bar, rod, or plate welded or otherwise attached to each of the pipes 216 above the former first end/top wall 217, while the second powered means 225 is connected in a like suitable manner to each of the pipes 219. The powered means 224, 225 are separate and distinct, and controlled separately by a conventional common control 227 (see FIG. 9) so that the positions of the bottom terminal portions of the first plurality of pipes 216 may be moved to different effective positions with respect to the second plurality of pipes 219, and vice versa. This movement in dimension 220 is accommodated by openings, such as the openings 228 for the pipes 216, and openings 229 for the pipes 219 provided in the former first end/top wall 217, is illustrated in FIG. 8. If movement just in the dimension 220 is desired, a flexible seal, such as an O-ring, or the like, may be provided between each of the pipes 216 and the openings 228, and the pipes 219 and the openings 229. Under some circumstances no seal is necessary.

In FIGS. 7, and 9 the powered means also comprise third and fourth powered elements, schematically illustrated as hydraulic or pneumatic pistons and cylinders, 231, 232 which are respectively operatively connected to the first plurality of pipes 216 and the second plurality of pipes 219 to move them in the second dimension 221 substantially transverse to the first dimension 220. While the powered means 231, 232 may be connected to the pipes 216, 219 in any suitable manner, it is preferred that—as illustrated in FIG. 7—they be connected to the first and second powered means 224, 225, respectively, to effect the movement in dimension 221. This movement in the dimension 221 may be accommodated by the openings 228, 229 (see FIG. 8) being elongated in the dimension 221, or a portion of the entire former first end/wall 217 may be mounted for movement in the dimension 221 in which case the openings 228, 229 need not be elongated.

Each of the pipes 216, 219 is preferably valved. For example as illustrated for just two of the pipes 216 in FIG. 7, valves 234 may be provided, while again just illustrated for two of the pipes 219 in FIG. 7, valves 235 are provided. Each of the valves 234, 235 may be separately controlled by the common computer control 227 (see FIG. 9) so that any one of the pipes 216, 219 may be opened any desired amount, or completely closed, to provide no flow, small flow, full flow, etc., of the third or fourth or more materials therethrough.

Although not shown in FIGS. 6 and 7 because of the closeness of the elements, each of the pipes 216, 219 is fed with a supply of a third or other material (such as a foam slurry, resin, SAP, etc.) illustrated schematically by feed no. 3 source 237 and feed no. 4 source 238 in FIG. 9, both also controlled by the common control 227, as well as the valves 234, 235 being controlled. For example the feed 237 may be connected up just to the first plurality of pipes 216 while the feed 238, of a different material than for the feed 237, is connected up just to the pipes 219; or any other number of different materials may be connected up to selected ones of each of the pipes 216, 219, etc.

The first and second volumes 105, 106 are connected up to the first and second feeds 239, 240, illustrated in FIGS. 6 and 9, also controlled by the common controller 227. Various other feeds may be provided, or assists for forming the web, depending upon the particular circumstances.

For example with the walls 214, 215 having their end terminations positioned as illustrated in FIGS. 6 and 7, the interior volume 241 above the end terminations of the walls 214, 215 may be a void area, in which gas (which may be slightly pressured if desired) may form or be introduced. For example the schematic illustration of the structure 242 in FIG. 6 may be for introducing pressurized inert gas (that is slightly above atmospheric pressure) into the void volume 241 to prevent any slurry from creeping up too high into the void volume 241. Alternatively, the volume 241 may be filled with slurry, and the structure 242—as illustrated in FIG. 9—may comprise a part of the means for introducing the at least a third material, namely a fifth material, through openings in or close to the former first end/top wall 217, so that the materials introduced by 237, 238 and 242 may all be different (or they all may be the same, or one different and the others the same). In this situation it would be highly desirable to seal the passage of each of the pipes 216, 219 through the former first ends/top plates 217, and this may be done utilizing any suitable conventional sealing means.

The controller 227, which also may control the suction boxes 31, 31A, may be a fuzzy controller, or any other conventional type of computer controller, either associated with or distinct from one or more of the controllers illustrated in FIG. 1.

Alternatively the pipes 216, 219 may be adjusted (with respect to the former second end/nip 218, or in the dimension 221) by manual means. For example with respect to adjustment in the dimension 220 the pipes 216, 219 may be screw threaded into collars in the former first end/top wall 217 so that by turning their positions may be adjusted. Also in any situation where significant adjustment/movement of the conduits 216, 219 is provided they are connected by flexible hoses (which may include universal joint couplings) to the feeds 237, 238.

It will thus be seen that according to the present invention a method and headbox assembly are provided which are highly advantageous in the formation of a variety of different types of non-woven webs, using foam slurries of air, water, cellulose or synthetic fibers, and surfactant. While the invention has been herein shown in what is presently conceived to be the most practical and preferred embodiment thereof it is to be understood that many modifications may be made thereof within the scope of the invention. For example the means for introducing foam and fiber slurries into the volumes 105, 106 may comprise any types of conduits, conduit branches, nozzles, orifices, or other conventional structures for introducing such a slurry, aside from those specifically illustrated in FIG. 4. Also the means for withdrawing foam from the slurries through the foraminous elements 90, 90A may be other structures besides the suction boxes 31, 31A, including suction rollers (such as roller 100 in FIG. 4), pressing rollers, or other conventional structures for that purpose. Also the means for introducing a third or more materials into the conduits within or forming part of the interior structure may be any conventional type of header, manifold, baffle, conduits, conduit branches, nozzles (including foam enhancing nozzles), or orifices, or other conventional structures. Thus the invention is to be accorded the broadest interpretation of the appended claims so as to encompass all equivalent methods and assemblies.

What is claimed is:

1. A twin wire former assembly comprising:

a former having a closed first end, closed first and second sides, and an interior volume;

a second end of said former provided by moving first and second foraminous elements;

an interior structure extending between said first and second sides, and having a discharge end with a plurality of discrete conduits therein extending from said first end toward said second end; said interior structure defining said interior volume into a first volume on one side thereof and a second volume on the other side thereof;

means for introducing a first fiber/foam slurry into the first volume, and a second fiber/foam slurry into the second volume;

means for withdrawing foam from the first and second slurries through said foraminous elements to form a non woven web on said foraminous elements; and means for introducing a third material into said conduits within said interior structure, wherein said interior structure is positioned to discharge the third material at a location past where said means for withdrawing foam from the first and second slurries starts withdrawing foam from the slurries.

2. A twin wire former assembly as recited in claim 1 wherein said means for introducing said fiber/foam slurries comprises means for introducing said fiber/foam slurries into said first and second volumes through said first and second side walls of said headbox.

3. A twin wire former assembly as recited in claim 1 wherein said means for introducing said fiber/foam slurries into said first and second volumes comprises a plurality of conduits disposed in said bottom of said headbox and facing upwardly.

4. A twin wire former assembly as recited in claim 3 further comprising means for introducing said fiber/foam slurries into said first and second volumes through said first and second side walls of said headbox.

5. A twin wire former assembly as recited in claim 1 wherein said interior structure is positioned with respect to said foraminous elements so that material introduced through said interior structure conduits will not directly contact said first and second foraminous elements.

6. A twin wire former assembly as recited in claim 1 wherein said means for withdrawing foam comprise first and second suction box assemblies mounted on the opposite sides of said interior structure from said foraminous elements.

7. A twin wire former as recited in claim 1 wherein said first end is the bottom and said second end the top of said former, said former being substantially vertical and flow through said conduits being substantially vertically upward.

8. A twin wire former assembly comprising:

a former having a closed first end, closed first and second sides, and an interior volume;

a second end of said former provided by moving first and second foraminous elements;

an interior structure extending between said first and second sides, and having a discharge end with a plurality of discrete conduits therein extending from said first end toward said second end; said interior structure defining said interior volume into a first volume on one side thereof and a second volume on the other side thereof;

means for introducing a first fiber/foam slurry into the first volume, and a second fiber/foam slurry into the second volume;

means for withdrawing foam from the first and second slurries through said foraminous elements to form a non woven web on said foraminous elements;

means for introducing a third material into said conduits within said interior structure; and foaming nozzles connected to said conduits and disposed in one or more of: said first end of said former; said side walls; and within said conduits.

9. A twin wire comprising:

a former having a closed first end, closed first and second sides, and an interior volume;

a second end of said former provided by moving first and second foraminous elements;

an interior structure extending between said first and second sides, and having a discharge end with a plurality of discrete conduits therein extending from said first end toward said second end; said interior structure defining said interior volume into a first volume on one side thereof and a second volume on the other side thereof;

means for introducing a first fiber/foam slurry into the first volume, and a second fiber/foam slurry into the second volume;

means for withdrawing foam from the first and second slurries through said foraminous elements to form a non woven web on said foraminous elements; and means for introducing a third material into said conduits within said interior structure;

means for introducing said fiber/foam slurries into said first and second volumes through said first and second side walls of said headbox;

wherein said means for introducing said fiber/foam slurries into said first and second volumes comprises a plurality of conduits disposed in said bottom of said headbox and facing upwardly;

foaming nozzles connected to said conduits disposed in said bottom of said headbox, and to said means for introducing fiber/foam slurries through said first and second side walls of said headbox.

10. A twin wire former assembly as recited in claim 9 wherein said interior structure is positioned to discharge the third material at a location past where said means for withdrawing foam from the first and second slurries starts withdrawing foam from the slurries.

11. A former assembly comprising:

a former having a closed first end, closed first and second sides, and an interior volume;

a second end of said former provided by a moving at least one foraminous element;

an interior structure between said first and second sides, said interior structure defining said interior volume into a first volume on one side thereof and a second volume on the other side thereof;

means for introducing a first fiber/foam slurry into the first volume, and a second fiber/foam slurry into the second volume;

means for withdrawing foam from the first and second slurries through said at least one foraminous element to form a non-woven web on said foraminous element; and means for introducing at least a third material through said interior structure in such a way that the third material forms stripes in the web produced.

12. A former assembly as recited in claim 11 wherein said means for introducing the at least a third material comprising a first plurality of pipes having a first effective length.

13. A former as recited in claim 12 wherein said introducing means further comprise introduction openings at said first end of said former spaced from terminal discharges of said first and second plurality of pipes.

14. A former assembly as recited in claim 12 wherein said introducing means comprises a second plurality of pipes having a second effective length different than said first length.

15. A former assembly as recited in claim 14 wherein said at least one foraminous element comprises first and second foraminous elements of a twin wire former; and further comprising first and second substantially solid wall elements straddling said first and second plurality of pipes and disposed between said first and second plurality of pipes and said first and second foraminous element, said wall elements each having a terminal portion closest to said second end of said former at a location past where said means for withdrawing foam from the first and second slurry starts withdrawing foam from the slurries.

16. A twin wire former assembly as recited in claim 15 wherein said first and second wall elements do not extend as far as said first and second plurality of pipes toward said second end of said former.

17. A former assembly as recited in claim 11 further comprising powered means for moving said introducing means to different positions within said interior structure to adjust the location within said interior structure that the at least a third material is introduced.

18. A former assembly as recited in claim 17 wherein said powered means comprise means for moving said introducing means toward and away from said second end of said former, and means for moving said introducing means in a dimension substantially transverse toward and away from said second end of said former.

19. A former assembly as recited in claim 11 wherein said interior structure is positioned at substantially all times during the normal range of movement thereof to discharge the at least a third material at a location past where the third material can mix with the other materials and come into contact with said at least one foraminous element.

20. A former assembly comprising:

a former having a closed first end, closed first and second sides, and an interior volume;

a second end of said former provided by a moving at least one foraminous element;

an interior structure extending between said first and second sides, said interior structure defining said interior volume into a first volume on one side thereof and a second volume on the other side thereof;

means for introducing a first fiber/foam slurry into the first volume, and a second fiber/foam slurry into the second volume;

means for withdrawing foam from the first and second slurries through said foraminous elements to form a non-woven web on said at least one foraminous element; and means for introducing at least a third material through said interior structure, said introducing means introducing the at least third material at a plurality of different points spaced different distances from said former second end.

21. A former assembly comprising:

a former having a closed first end, closed first and second sides, and an interior volume;

a second end of said former provided by moving at least one foraminous element;

an interior structure extending between said first and second sides, and having a discharge end with a plurality of discrete conduits therein extending from said first toward said second end; said interior structure defining said interior volume into a first volume on one side thereof and a second volume on the other side thereof;

means for introducing a first fiber/foam slurry into the first volume, and a second fiber/foam slurry into the second volume;

means for withdrawing foam from the first and second slurries through said at least one foraminous element to form a non woven web on said foraminous element; and means for introducing a third material into said conduits within said interior structure at a location at which the third material will not directly contact said at least one foraminous element, wherein said means for introducing includes foaming nozzles coupled to said conduits and said nozzles are disposed in one or more of said first end of the former, said interior structure and within said conduits.

* * * * *